US011707750B2

(12) United States Patent
Hong

(10) Patent No.: US 11,707,750 B2
(45) Date of Patent: Jul. 25, 2023

(54) NOZZLE ASSEMBLY FOR SPRAYER

(71) Applicant: SMBURE CO., LTD., Gwangju (KR)

(72) Inventor: Gi Sool Hong, Gwangju (KR)

(73) Assignee: SMBURE CO., LTD., Gwangju (KR)

( * ) Notice: Subject to any disclaimer, the term of this patent is extended or adjusted under 35 U.S.C. 154(b) by 39 days.

(21) Appl. No.: 17/478,407

(22) Filed: Sep. 17, 2021

(65) Prior Publication Data

US 2023/0015593 A1 Jan. 19, 2023

(30) Foreign Application Priority Data

Jul. 16, 2021 (KR) ..... 10-2021-0093731

(51) Int. Cl.
*B05B 1/04* (2006.01)
*B05B 1/30* (2006.01)

(52) U.S. Cl.
CPC ..... *B05B 1/042* (2013.01); *B05B 1/3006* (2013.01)

(58) Field of Classification Search
CPC ..... B05B 13/0636; B05B 1/14; B05B 3/06; B05B 7/0075; B05B 1/042; A47L 15/23
See application file for complete search history.

(56) References Cited

U.S. PATENT DOCUMENTS 2,585,608 A * 2/1952 Wieghart ..... A47L 15/23 239/521
3,361,361 A * 1/1968 Schutte ..... A47L 15/23 134/179
4,405,087 A * 9/1983 Mata-Garza ..... B05B 3/0427 417/171
6,775,865 B1 * 8/2004 Lin ..... E03C 1/0408 4/596
8,667,987 B2 * 3/2014 Zink ..... B05B 13/0627 137/881
9,736,123 B2 * 8/2017 Xu ..... H04L 9/3247
D809,100 S * 1/2018 Hong ..... D8/2
9,878,337 B1 * 1/2018 Hong ..... B05B 7/0075
10,660,499 B2 * 5/2020 Woo ..... A47L 15/4282
11,433,408 B2 * 9/2022 Dane ..... B05B 17/08
D965,744 S * 10/2022 Li ..... D23/225
2002/0003173 A1 * 1/2002 Bauer ..... B08B 9/049 239/722
2007/0209632 A1 * 9/2007 Wagner ..... F01C 21/104 418/35
2012/0168538 A1 * 7/2012 Han ..... B05B 3/06 239/589

(Continued)

FOREIGN PATENT DOCUMENTS

KR 101880552 B1 7/2018
KR 101880545 B1 8/2018

*Primary Examiner* — Joseph A Greenlund

(57) ABSTRACT

Disclosed is a nozzle assembly for a sprayer, when a power of a sprayer is turned OFF, capable of not only minimizing an amount of liquid chemical remaining in a flow path at an inner side of a nozzle but also preventing backflow of the liquid chemical. The a nozzle assembly for a sprayer includes a nozzle assembly body molded in a '+' shape; a nozzle assembled and installed in each of the plurality of nozzle assembly holes; a plurality of insert pieces fitting from an outside to an inside of four directions of a slide hole formed in a '+' shape and forming a flow path for guiding a fluid flowing; and an end cap fixed and coupled to an outside in four directions of the slide hole in a state.

7 Claims, 9 Drawing Sheets

(56) References Cited

U.S. PATENT DOCUMENTS

| | | | | |
|---|---|---|---|---|
| 2012/0175431 | A1* | 7/2012 | Althammer | A61B 90/70 239/263 |
| 2012/0205405 | A1* | 8/2012 | Zink | B08B 3/02 251/336 |
| 2020/0254466 | A1* | 8/2020 | Dane | B05B 1/28 |
| 2020/0337520 | A1* | 10/2020 | Kwon | A47L 15/4214 |
| 2020/0391233 | A1* | 12/2020 | Woolard | B05B 3/12 |
| 2021/0228056 | A1* | 7/2021 | Xiong | B05B 3/06 |
| 2022/0032329 | A1* | 2/2022 | Qiao | B05B 15/652 |
| 2023/0015593 | A1* | 1/2023 | Hong | B05B 7/0892 |

* cited by examiner

[Fig. 1]
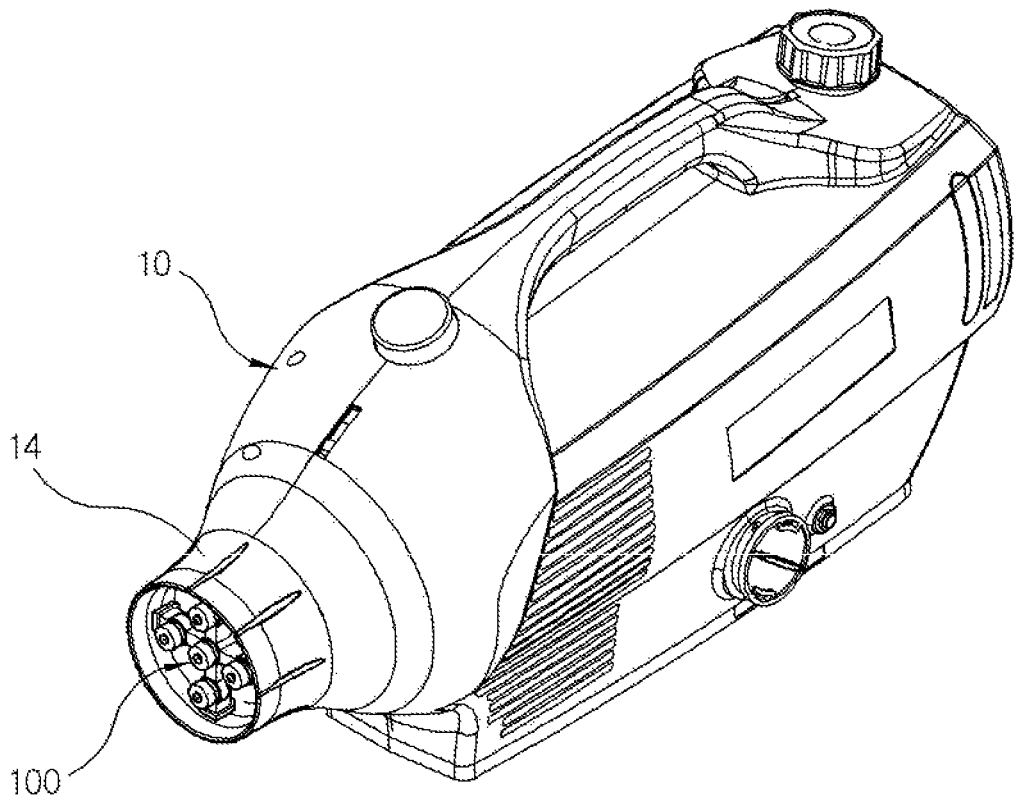

[Fig. 2]
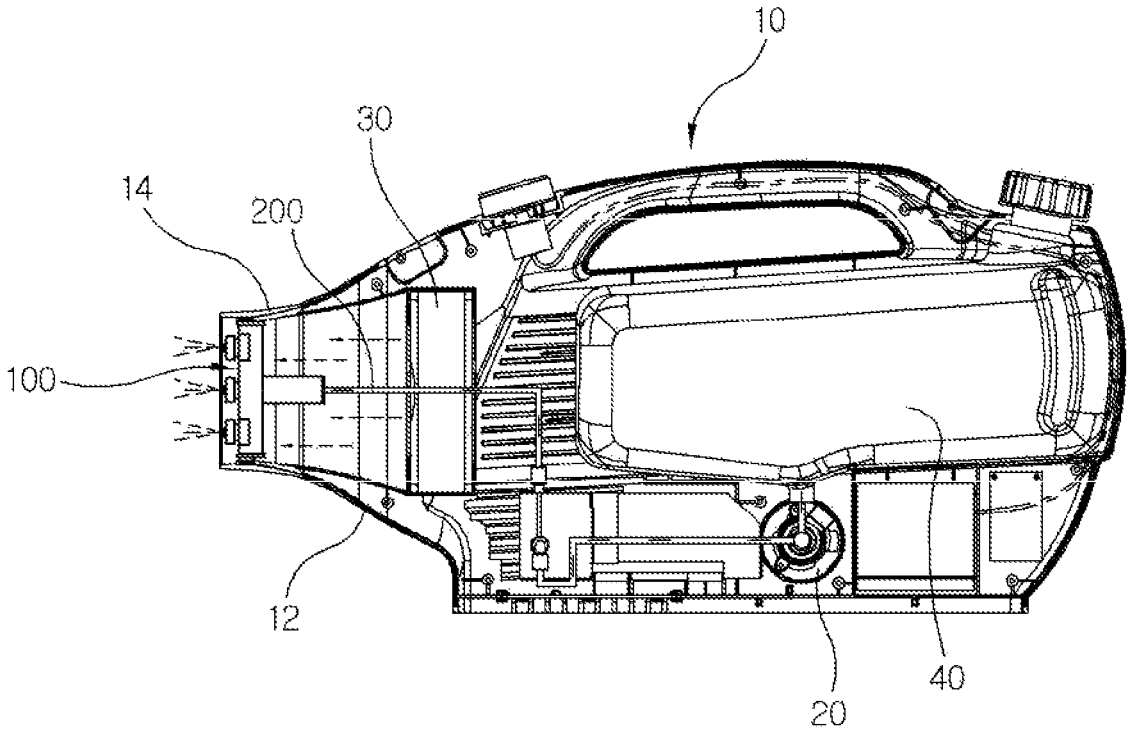

[Fig. 3]
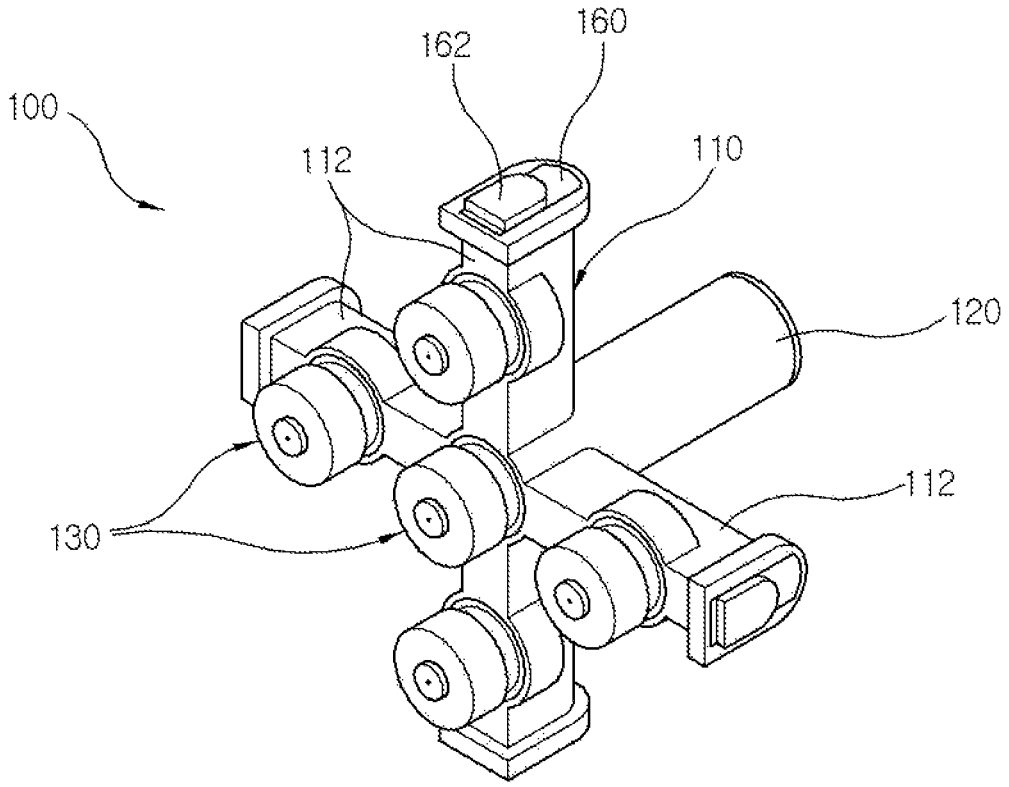

[Fig. 4]
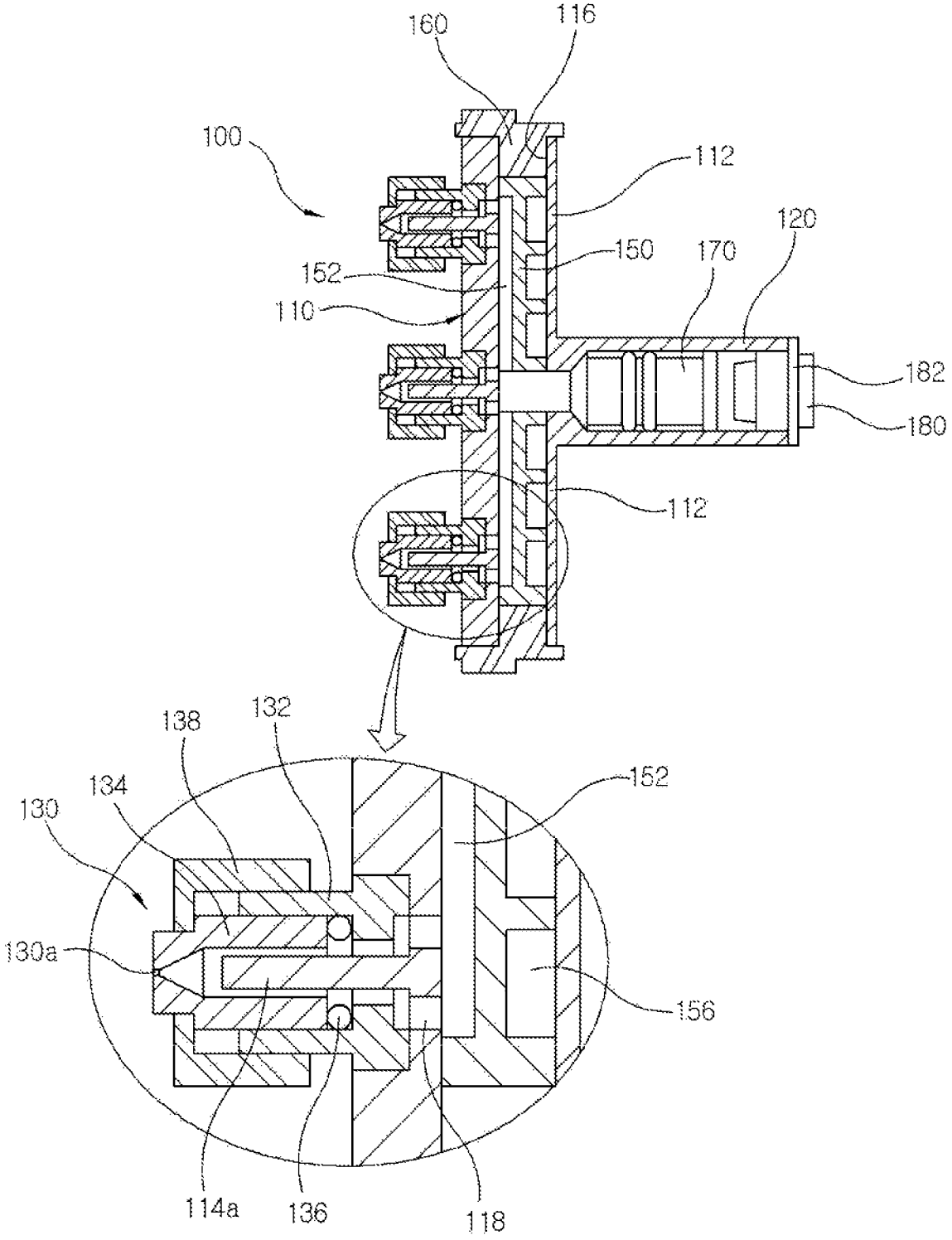

[Fig. 5]
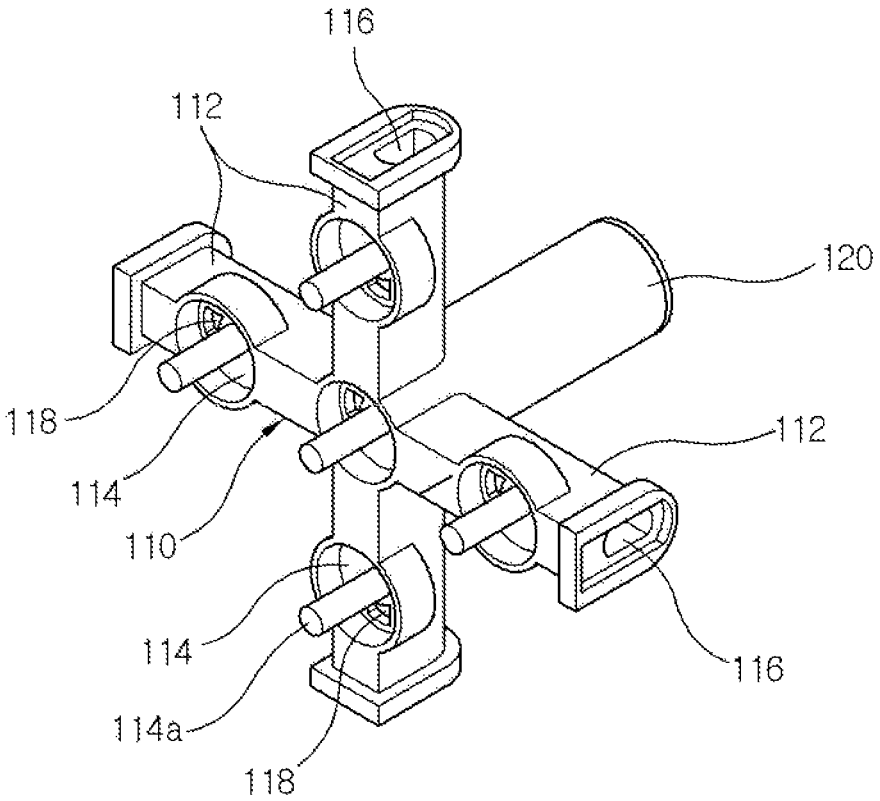

[Fig. 6]
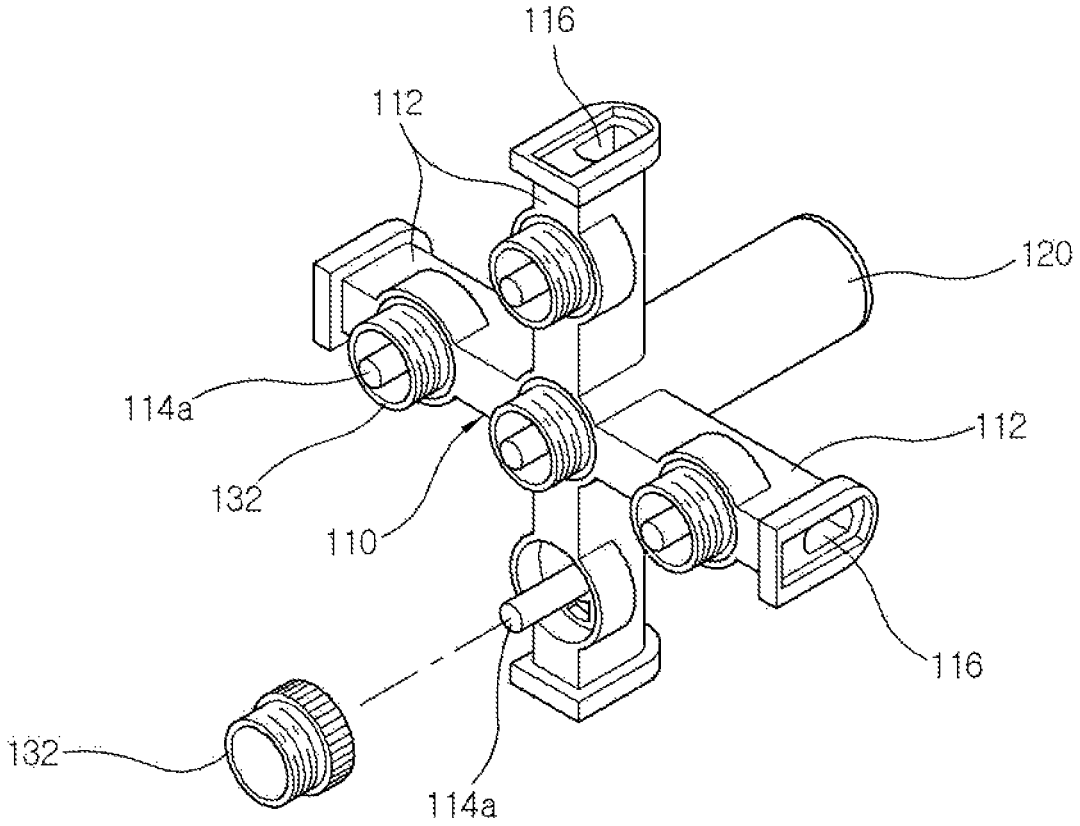

[Fig. 7]
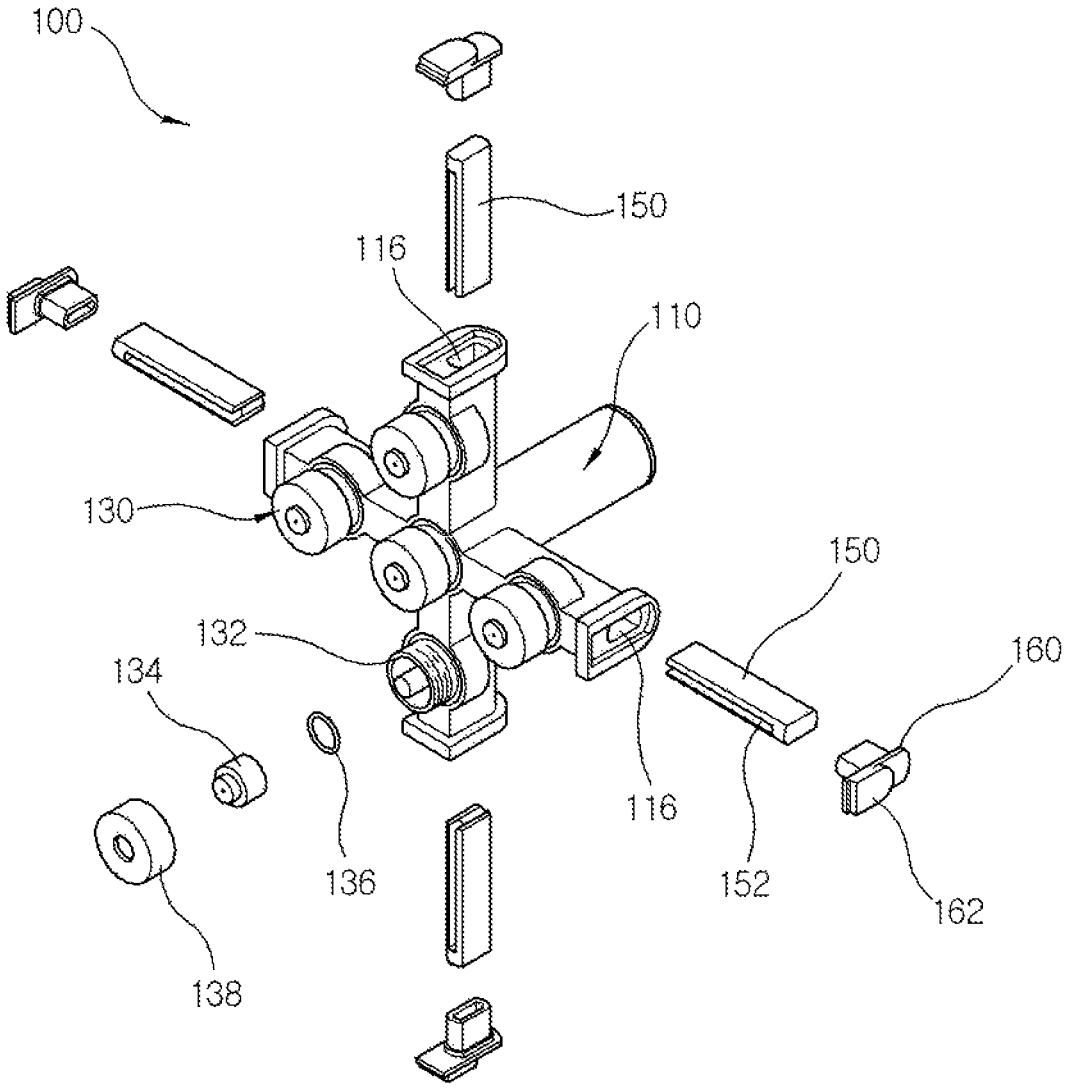

[Fig. 8]
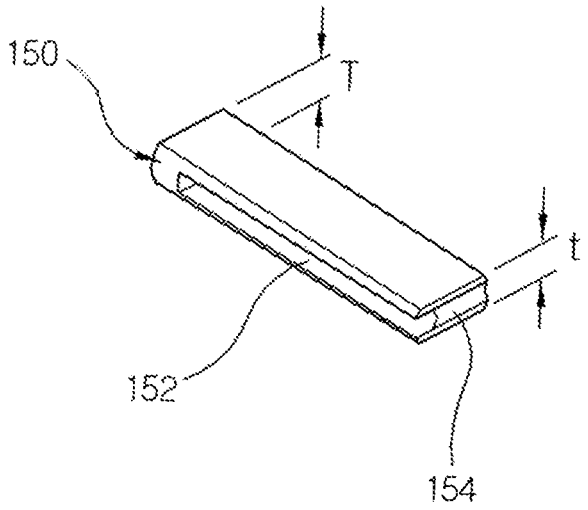
[Fig. 9]
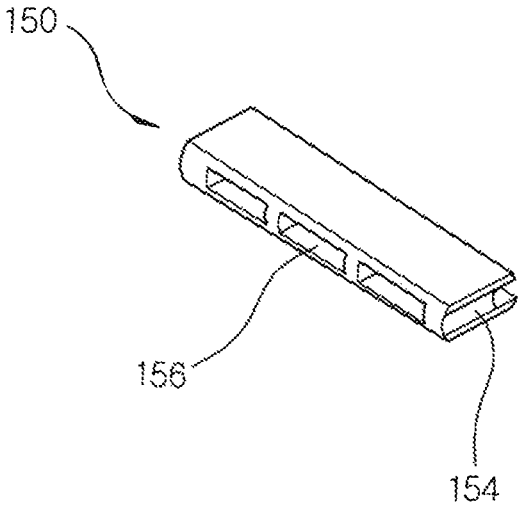

[Fig. 10]
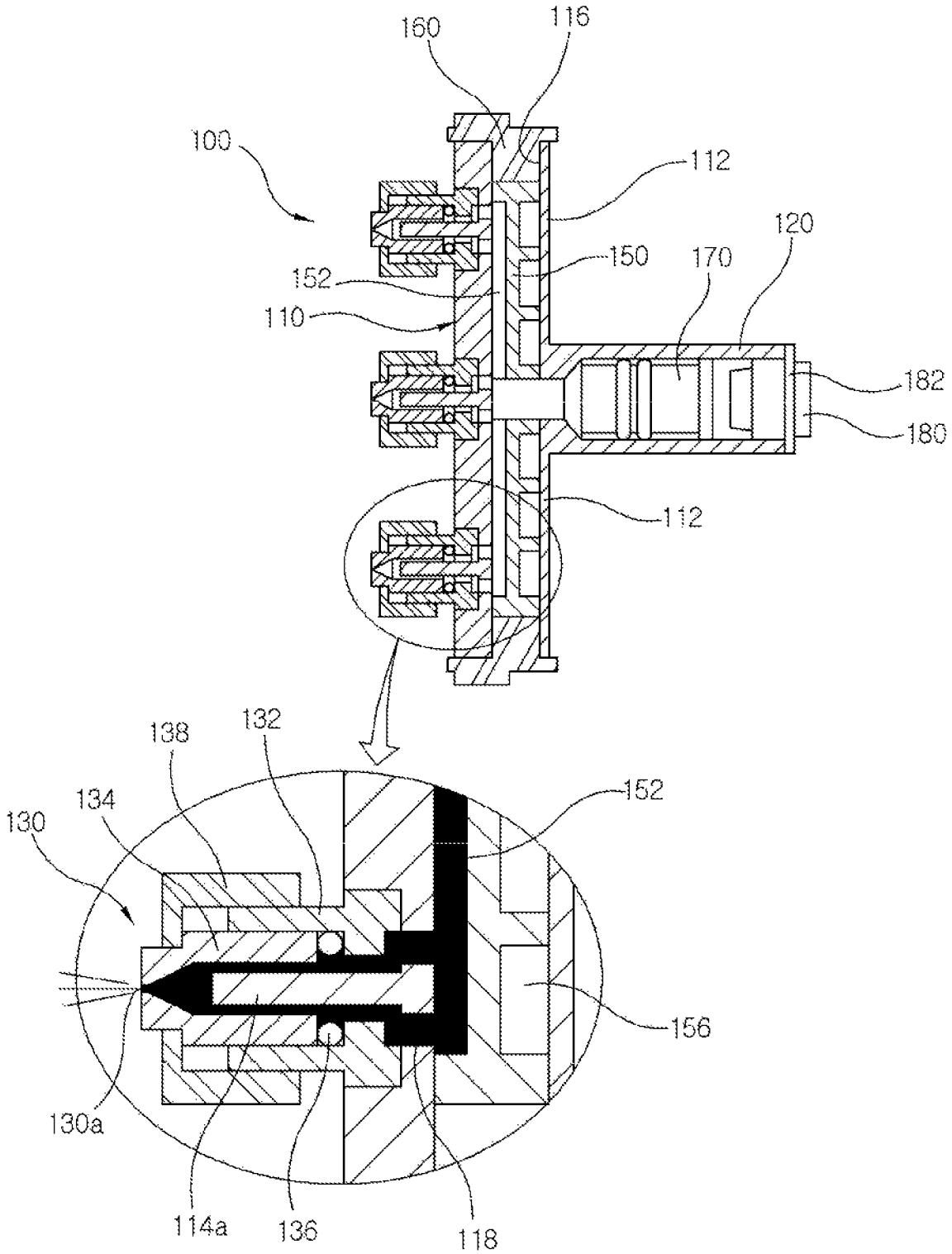

NOZZLE ASSEMBLY FOR SPRAYER

TECHNICAL FIELD

The present invention relates to a nozzle assembly for a sprayer, and more particularly to a nozzle assembly for a sprayer, when a power of a sprayer is turned OFF, capable of not only minimizing an amount of liquid chemical remaining in a flow path at an inner side of a nozzle but also preventing backflow of the liquid chemical, and being more stably installed at an inner side of an air blowing spray port provided at a front side of the sprayer.

DISCUSSION OF RELATED ART

A sprayer is an apparatus used to spray liquid containing an insecticide or disinfectant into a wide spraying portion, and may be classified into various types according to a liquid chemical pumping method.

The sprayer disclosed in Korean Patent Registration No. 10-1880545 is configured such that liquid chemical stored in a liquid chemical container is pumped by a pump and then delivered to a nozzle along a liquid chemical supply pipe, in a process of spraying the liquid chemical via the nozzle assembled and installed at a front side of a main body of the sprayer, a strong air pressure is provided to an air blowing spray port provided in the front of the main body of the sprayer so that the liquid chemical sprayed from the nozzle is sprayed in a particulate state.

Meanwhile, the sprayer configured as described above has a structure in which a plurality of nozzles are mounted at a nozzle assembly configured in a '+' shape when viewed from the front. The nozzle assembly molded in a '+' shape, and formed a flow path therein includes a nozzle assembly body in which nozzle assembly holes are formed at a plurality of locations along the flow path, and a nozzle assembled and installed in the nozzle assembly hole provided in front of the nozzle assembly body.

However, the nozzle assembly body configuring the nozzle assembly is molded via a plastic molding process, and there are many things to consider at designing such that a flow path should be not only formed at an inner side of the nozzle assembly body, but also the nozzle should be inserted and molded in a plurality of locations, and the air blowing spray port formed in the front of the sprayer should be able to be stably installed, and further, sufficient durability for long-term use should be ensured.

In addition, there is a problem in that the liquid chemical remains in the flow path formed at an inner side of the nozzle assembly, when a user turns OFF a power to temporarily or completely stop using a sprayer while using the sprayer.

RELATED ART DOCUMENT

Patent Document (Patent Document 0001) Korean Patent Registration No. 10-1880552 (2018.07.20)

(Patent Document 0002) Korean Patent Registration No. 10-1880545 (2018.08.17)

SUMMARY OF DISCLOSURE

Technical Problem

The present invention is directed to solving the above described problems and providing a nozzle assembly of a sprayer, when a user turns OFF a power of a sprayer, capable of not only minimizing an amount of liquid chemical remaining in a flow path at an inner side of a nozzle but also preventing backflow of the liquid chemical, and being more stably installed at an inner side of an air blowing spray port provided at a front side of the sprayer.

Technical Solution

In order to achieve the above object, the present invention may be configured as follows.

A nozzle assembly for a sprayer according to one embodiment of the present invention includes a nozzle assembly body molded in a '+' shape via a plastic molding process but interconnected with a slide hole formed at an inner portion of a branch part extending in four directions based on a center, and having a structure in a circular shape which communicates with a slide holes at the front and forming a plurality of nozzle assembly holes with a central protrusion protruding from a center at predetermined intervals, on the other hand, forming a cylindrical connection part having a predetermined length protruding from a center of the rear; a nozzle assembled and installed in each of the plurality of nozzle assembly holes; a plurality of insert pieces fitting from an outside to an inside in four directions of a slide hole formed in a '+' shape in the nozzle assembly body to block a part of the slide hole and forming a flow path for guiding a fluid flowing in via a connection part toward the nozzle assembly hole at one side; and an end cap fixed and coupled to an outside of the slide hole in a state in which the insert piece is inserted from an outside toward an inside of the slide hole formed in a '+' shape in the nozzle assembly body.

In the nozzle assembly for the sprayer according to one embodiment of the present invention, the insert piece may be formed in a form of an approximately hexahedron having a predetermined thickness, width and length, but a flow path having a predetermined depth may be formed long in a longitudinal direction at one side in a thickness direction, and the flow path may have a structure to communicate with one end in a longitudinal direction of the insert piece, but to be blocked from the other end.

In the nozzle assembly for the sprayer according to one embodiment of the present invention, a plurality of thinning grooves having a predetermined depth may be formed at a side surface of another side surface of the insert piece in a thickness direction.

In the nozzle assembly for the sprayer according to one embodiment of the present invention, a side surface flow path may have a structure formed at an inner side end in a longitudinal direction of the insert piece, and the side surface flow path may have a structure connected to the flow path.

The nozzle installed in the nozzle assembly hole in the nozzle assembly for the sprayer according to one embodiment of the present invention may include a nozzle fixing screw to be inserted into the nozzle assembly hole, a nozzle body installed at an inner side of the nozzle fixing screw when inserted into a front end of the central protrusion, a packing installed at an inner side of the nozzle fixing screw to maintain airtightness between the nozzle assembly hole and the nozzle body, and a nozzle cap coupled to the nozzle fixing screw in a state of enclosing an outer portion of the nozzle body.

In the nozzle assembly for the sprayer according to one embodiment of the present invention, a protrusion having a predetermined height may be formed at an outside surface of the end cap.

In the nozzle assembly for the sprayer according to one embodiment of the present invention, a check valve may be assembled and installed at an inner portion of the cylindrical connection part of the nozzle assembly body, a connector for connecting an end of the liquid chemical supply pipe may be installed at an outer portion side of the check valve, and a separation preventing cap may be fixed and installed at an outer side end of the connection part.

Advantageous Effects

In a nozzle assembly for a sprayer according to one embodiment of the present invention, a user operates a switch to 'OFF', and simultaneously, supply of liquid chemical transferring toward a nozzle is quickly and stably blocked, and thus there is a great advantage that an amount of liquid chemical remaining in a flow path can be minimized.

In addition, in the nozzle assembly for the sprayer according to the present invention, a slide hole generated in a process of being manufactured via a plastic molding process is filled with an insert piece, and thus there is an advantage that rigidity can be reinforced.

DESCRIPTION OF DRAWINGS

FIGS. 1 and 2 are views for describing a configuration of a sprayer to which a nozzle assembly according to one embodiment of the present invention is applied.

FIG. 3 is a perspective view of a nozzle assembly according to one embodiment of the present invention.

FIG. 4 is a cross-sectional view of a nozzle assembly according to one embodiment of the present invention.

FIGS. 5, 6 and 7 are exploded perspective views for describing a process in which a nozzle assembly according to one embodiment of the present invention is manufactured.

FIGS. 8 and 9 are views for describing a configuration of an insert piece according to one embodiment of the present invention.

FIG. 10 is a view for describing a process in which a fluid is sprayed from a nozzle assembly according to one embodiment of the present invention.

DETAILED DESCRIPTION OF EXEMPLARY EMBODIMENTS

Hereinafter, a configuration of the nozzle assembly for the sprayer according to one embodiment of the present invention will be described in detail with reference to the accompanying drawings.

Reference numeral 100 indicated in the drawings indicates a nozzle assembly according to an embodiment of the present invention, and reference numeral 10 indicates an example of a sprayer to which the nozzle assembly according to an embodiment of the present invention is applied.

As shown in FIGS. 1 and 2, a nozzle assembly 100 according to one embodiment of the present invention is fixed and installed at an inner side of an air blowing spray port 14 provided at a front side of a sprayer 10, and each end of a branch part 112 extending in a '+' shape toward four directions is fixed and installed at an inner side surface of the air blowing spray port 14.

In the above-described sprayer 10, when a user turns On an operation switch, a pump 20 and an air blowing fan 30 installed at an inner portion of a housing 12 operate, and liquid chemical stored in a liquid chemical container 40 is pumped by the pump 20 and sprayed via the nozzle assembly 100. As the air blowing fan 30 operates together with an operation of the pump 20, strong air pressure is provided toward the air blowing spray port 14, so that the liquid chemical sprayed from the nozzle assembly 100 is sprayed in a particulate state by a pressure of a strong wind.

The nozzle assembly 100 according to an embodiment of the present invention includes, as shown in FIG. 3, a nozzle assembly body 110 in which the branch part 112 is formed in a '+' shape, and a connection part 120 in a cylindrical shape having a predetermined length is formed toward a rear side of a center thereof, a nozzle 130 assembled and installed in a nozzle assembly hole 114 formed in a plurality of locations at a predetermined interval in the front of the nozzle assembly body 110, while a part of a '+'-shaped slide hole 116 formed at an inner side of the nozzle assembly body 110 in a molding process of the nozzle assembly body 110 is blocked, an insert piece 150 in which a flow path 152 for guiding the liquid chemical toward the nozzle 130 is formed, and an end cap 160 fixed and coupled to an opened outer side of the slide hole 116 in a state in which the insert piece 150 is inserted inside the slide hole 116 of the nozzle assembly body 110.

The nozzle assembly body 110 of the nozzle assembly 100 according to one embodiment of the present invention may be manufactured via a plastic molding process. In the nozzle assembly body 110, when viewed from a front or rear side, the branch part 112 is formed in a structure extending in a '+' shape in upper, lower, left and right sides with respect to a center, and at the rear side, the connection part 120 in a cylindrical shape having a predetermined length with respect to the center is formed protruding. A liquid chemical supply pipe 200 is connected to the connection part 120.

In the front of the nozzle assembly body 110, a nozzle assembly holes 114 are formed at a plurality of locations at predetermined intervals, the nozzle assembly hole 114 is formed in a structure in a circular shape communicating via the slide hole 116 and a through hole 118 formed in a '+' shape, and a central protrusion 114*a* at a center is formed in a structure protruding toward the front by a predetermined length.

As described above, the nozzles 130 are respectively installed in the nozzle assembly holes 114 formed at a plurality of locations.

The nozzle 130 includes a nozzle fixing screw 132 inserted into the nozzle assembly hole 114, when inserted to a front end of the central protrusion 114*a*, a nozzle body 134 installed at an inner side of the nozzle fixing screw 132, a packing 136 installed at an inner side of the nozzle fixing screw 132 to maintain airtightness between the nozzle assembly hole 114 and the nozzle body 134, and a nozzle cap 138 coupled to the nozzle fixing screw 132 in a state in which an outer portion of the nozzle body 134 is enclosed.

In particular, the slide hole 116 is formed by a slide of an injection mold while the nozzle assembly body 110 of the nozzle assembly 100 according to an embodiment of the present invention is molded via a molding process and the present slide hole 116 is to deliver liquid chemical to the nozzle 130 and is formed to have a cross-sectional area more than necessary compared with a cross-sectional area of a required flow path. Accordingly, the insert piece 150 formed to have a cross-sectional area corresponding to a cross-sectional area of the slide hole 116 is fitted into and blocks the slide hole 116.

The insert piece 150 may be formed in a shape close to a substantially hexahedron having a thickness, a width, and a length, as shown in FIG. 7.

Meanwhile, the flow path 152 having a predetermined depth at a side surface of one side of the insert piece 150 in a thickness direction is formed long in a longitudinal direction, so that liquid chemical supplied via the liquid chemical supply pipe 200 connected to the connection part 120 may be delivered to the nozzle 130 in an appropriate amount. At this point, the flow path 152 communicates with one end of the insert piece 150 in a longitudinal direction but is formed to be blocked from the other end.

In particular, as shown in FIG. 8, the insert piece 150 is preferably formed so that an outer thickness T is thick compared with an inner thickness t. That is, a structure may be tapered at a predetermined angle in a longitudinal direction. As the insert piece 150 is formed in a structure tapered at a predetermined angle as described above, assembly and airtightness are improved. As described above, in response to the insert piece 150 having an inclined structure, the slide hole 116 may also have a structure in which a cross-sectional area is gradually reduced from the outside to the inside.

Preferably, as shown in the drawings, a side surface flow path 154 may be formed at an inner end of the insert piece 150 in a longitudinal direction. The side surface flow path 154 communicates with the flow path 152.

In addition, as shown in FIG. 9, a plurality of thinning grooves 156 having a predetermined depth may be formed at a side surface of another side of the insert piece 150 in a thickness direction.

Meanwhile, the insert piece 150 is inserted into the slide hole 116 such that the flow path 152 formed at one side surface faces the nozzle assembly hole 114.

As described above, in a state in which the insert piece 150 is inserted into the slide hole 116, the insert piece 150 is not detached by an external force so that an assembled and installed state may not only be stably maintained but also airtightness may be maintained, so that the end cap 160 is fixed and installed at an outer side end portion of the slide hole 116 by a thermal fusion process or the like.

That is, as shown in the drawing, the insert piece 150 is inserted from an outside toward an inside of the slide hole 116 formed in a '+' shape in the nozzle assembly body 110, and then the end cap 160 is fixed and mounted to an outer side of the slide hole 116.

In addition, a protrusion 162 having a predetermined height may be formed protruding on an outer side surface of the end cap 160 fixed and coupled to end portions in four direction of the nozzle assembly body 110.

A check valve 170 is assembled and installed at an inner portion of the connection part 120 formed protruding to the rear of the above-described nozzle assembly body 110, and a connector 180 for connecting an end of the liquid chemical supply pipe 200 is assembled and installed at an outer side of the check valve 170. In addition, a separation preventing cap 182 for preventing separation of the check valve 170 and the connector 180 is fixed and installed at an outer side end of the connection part 120.

Accordingly, the liquid chemical supply pipe 200 may be stably connected to the connection part 120, and leakage of the liquid chemical is prevented.

When the sprayer 10 equipped with the nozzle assembly 100 configured as described above is operated, the liquid chemical supplied via the liquid chemical supply pipe 200 connected to the connection part 120 is supplied to the nozzle 130 along the flow path 152 formed at the insert piece 150 as shown in FIG. 10 and sprayed via the nozzle hole 130*a*.

Meanwhile, the liquid chemical sprayed via the nozzle 130 is atomized and sprayed by the air of a strong pressure applied from the air blowing fan 30 side.

When a user who used the sprayer 10 equipped with the nozzle assembly 100 configured as described above turns OFF the sprayer 10, as driving of the pump 20 is stopped, the liquid chemical of supplying to the liquid chemical supply pipe 200 is blocked.

In addition, the check valve 170 is assembled and installed at an inner side of the connection part 120 of the nozzle assembly 100, so that the check valve 170 is not only not opened under a predetermined pressure but also backflow of the liquid chemical is blocked, so that the liquid chemical supplied via the liquid chemical supply pipe 200 is not flowed even in a forward direction.

In particular, in the nozzle assembly 100 according to one embodiment of the present invention, the flow path from the check valve 170 to the nozzle 130 is formed short and the flow path 152 having a fine cross-sectional area is formed at one side surface of the insert piece 150, so that it is a useful effect that the liquid chemical sprayed via the nozzle 130 can be blocked almost simultaneous as the user of the sprayer is turned OFF.

In the above, a configuration and operating state of the nozzle assembly for the sprayer according to an embodiment of the present invention have been described in detail. Such embodiments are included in technical spirits described in the claims of the present invention. In addition, such embodiments are merely exemplary, and should not be construed as limited in interpreting claims of the present invention.

DESCRIPTION OF REFERENCE NUMERALS

10: Sprayer 12: Housing
14: Air blowing spray port 20: Pump
30: Air blowing fan 40: Liquid chemical container
100: Nozzle assembly 110: Nozzle assembly body
112: Branch part 114: Nozzle assembly hole
114*a*: Central protrusion 120: Connection part
130: Nozzle 132: Nozzle fixing screw
134: Nozzle body 138: Nozzle cap
150: Insert piece 152: flow path
154: Side surface flow path 156: Thinning groove
160: End cap 170: Check valve
180: Connector 200: Liquid chemical supply pipe

The invention claimed is:

1. A sprayer nozzle assembly, comprising:

a nozzle assembly body molded via a plastic injection process and including:

a branch part extending from a center of the nozzle assembly body and including a slide hole that has a '+' shape;

a plurality of nozzle assembly holes disposed at a front of the nozzle assembly body and formed at predetermined intervals, each of the plurality of nozzle assembly holes having a structure in a circular shape which communicates with the slide hole and having a central protrusion protruding toward the front of the nozzle assembly body; and a connection part having a predetermined length and formed to protrude at a rear center of the nozzle assembly body;

a nozzle assembled and installed in each of the plurality of nozzle assembly holes;

a plurality of insert pieces each fitting from an outside to an inside in a corresponding one of four directions of the slide hole formed in the '+' shape in the nozzle assembly body to block a part of the slide hole and forming a flow path for guiding a fluid flowing in via the connection part toward the nozzle assembly hole; and an end cap fixed and coupled to an outer side of the slide hole in a state in which the insert piece is inserted from the outside to the inside of the slide hole formed in the '+' shape in the nozzle assembly body.

2. The nozzle assembly for the sprayer of claim 1, wherein the insert piece is formed in a form of an approximately hexahedron having a predetermined thickness, width and length, the flow path having a predetermined depth is formed at one side in a thickness direction of the insert piece to extend in a longitudinal direction of the insert piece, and the flow path has a structure to communicate with one end in the longitudinal direction of the insert piece, and to be blocked from the other end.

3. The nozzle assembly for the sprayer of claim 2, wherein a plurality of thinning grooves having a predetermined depth is formed at the other side of the insert piece in the thickness direction.

4. The nozzle assembly for the sprayer of claim 3, wherein a side surface flow path is formed at an inner side end in the longitudinal direction of the insert piece, and the side surface flow path is connected to the flow path.

5. The nozzle assembly for the sprayer of claim 1, wherein the nozzle installed in the nozzle assembly hole comprises a nozzle fixing screw to be inserted into the nozzle assembly hole, a nozzle body installed at an inner side of the nozzle fixing screw when inserted into a front end of the central protrusion, a packing installed at an inner side of the nozzle fixing screw to maintain airtightness between the nozzle assembly hole and the nozzle body, and a nozzle cap coupled to the nozzle fixing screw in a state of enclosing an outer portion of the nozzle body.

6. The nozzle assembly for the sprayer of claim 1, wherein a protrusion having a predetermined height is formed at an outside surface of the end cap.

7. The nozzle assembly for the sprayer of claim 1, further comprising:

a check valve assembled and installed at an inner portion of the connection part of the nozzle assembly body;

a connector connecting an end of a liquid chemical supply pipe and installed at an outer portion side of the check valve; and a separation preventing cap is fixed and installed at an outer side end of the connection part.

* * * * *